US010677541B2

(12) United States Patent
Cukurel

(10) Patent No.: US 10,677,541 B2
(45) Date of Patent: Jun. 9, 2020

(54) ACOUSTIC RESONANCE EXCITED HEAT EXCHANGE

(71) Applicant: TECHNION RESEARCH & DEVELOPMENT FOUNDATION LIMITED, Haifa (IL)

(72) Inventor: Beni Cukurel, Kibbutz Nachsholim (IL)

(73) Assignee: Technion Research & Development Foundation Limited, Haifa (IL)

( * ) Notice: Subject to any disclaimer, the term of this patent is extended or adjusted under 35 U.S.C. 154(b) by 0 days.

(21) Appl. No.: 16/060,958

(22) PCT Filed: Dec. 15, 2015

(86) PCT No.: PCT/IB2015/059642
§ 371 (c)(1),
(2) Date: Jun. 11, 2018

(87) PCT Pub. No.: WO2017/103650
PCT Pub. Date: Jun. 22, 2017

(65) Prior Publication Data

US 2018/0363991 A1 Dec. 20, 2018

(51) Int. Cl.
*F28F 3/14* (2006.01)
*F28F 13/10* (2006.01)
(Continued)

(52) U.S. Cl.
CPC ..... *F28F 13/10* (2013.01); *F01D 5/00* (2013.01); *F01D 5/187* (2013.01);
(Continued)

(58) Field of Classification Search
CPC . F28F 13/00; F28F 13/10; F28F 3/025; F25B 21/00; F01D 1/587; F01D 5/00;
(Continued)

(56) References Cited

U.S. PATENT DOCUMENTS 2,664,274 A 12/1953 Worn
4,604,031 A 8/1986 Moss
(Continued)

FOREIGN PATENT DOCUMENTS

CN 101476826 12/2010
CN 102829652 12/2012
JP 2014081168 8/2014

OTHER PUBLICATIONS

K.K. Ahuja R.R. Whipkey and G.S. Jones, Control of Turbulent Boundary Layer Flows by Sound AIAA 8th Aeroacoustics Conference, Apr. 11-13, 1983 / Atlanta, Georgia.
(Continued)

*Primary Examiner* — Davis D Hwu
(74) *Attorney, Agent, or Firm* — Daniel Feigelson; Fourth Dimension IP

(57) ABSTRACT

New exemplary heat exchange configurations that incorporate internal or external surfaces equipped with perturbators, for changing the thermal behavior of the system, or for modulating the surface temperature distribution of the flow surfaces. This is achieved by applying an acoustic wave to the fluid flow in a heat exchange passage, and selecting the frequency of the acoustic exciting wave to be the same as the acoustic resonance frequency of the heat exchange passage itself. As the traveling waves interact with the boundaries confining the heat exchange passages, constructive interference of the incident and reflected waves give rise to a standing wave. Thus, the heat exchange passages act as a resonator, and by superimposing this standing wave on the separating and reattaching fluid flow, significant heat transfer improvement can be achieved. This is accomplished without the need to significantly increase the pressure required to achieve the desired through flow.

20 Claims, 8 Drawing Sheets

(51) Int. Cl.

| | |
|---|---|
| ***F01D 5/00*** | (2006.01) |
| ***F01D 5/18*** | (2006.01) |
| *F28D 9/00* | (2006.01) |
| *F28D 21/00* | (2006.01) |
| *F28F 3/02* | (2006.01) |

(52) U.S. Cl.
CPC ..... *F05D 2220/30* (2013.01); *F05D 2240/30* (2013.01); *F05D 2260/16* (2013.01); *F05D 2260/213* (2013.01); *F05D 2260/22141* (2013.01); *F05D 2270/18* (2013.01); *F28D 9/005* (2013.01); *F28D 2021/0021* (2013.01); *F28D 2021/0026* (2013.01); *F28F 3/025* (2013.01)

(58) Field of Classification Search
CPC ..... F05D 2220/30; F05D 2240/30; F05D 2260/16; F05D 2260/213; F05D 2260/22141; F05D 2270/18; B06B 1/02; A61M 5/142; F28D 9/005; F28D 2021/0026
USPC ..... 165/170
See application file for complete search history.

(56) References Cited

U.S. PATENT DOCUMENTS

| | | | | |
|---|---|---|---|---|
| 4,805,318 | A | 2/1989 | Bramlette | |
| 5,579,399 | A * | 11/1996 | Lucas | G10K 11/04 381/165 |
| 5,797,414 | A * | 8/1998 | Sirovich | B64C 21/10 137/13 |
| 2006/0096092 | A1 | 11/2006 | Pietraszkiewicz | |
| 2007/0164641 | A1* | 7/2007 | Pelrine | A61M 5/142 310/11 |
| 2008/0291784 | A1* | 11/2008 | Yamanaka | B06B 1/02 367/99 |
| 2012/0145361 | A1* | 6/2012 | Glezer | F28F 13/00 165/109.1 |
| 2014/0270723 | A1* | 9/2014 | Froussart | H05B 1/0275 392/322 |
| 2017/0146270 | A1* | 5/2017 | Colognesi | F25B 21/00 |

OTHER PUBLICATIONS

Kenneth R. Purdy, Thomas W. Jackson; Viscous Compressible Fluid Flow Under the Influence of a Resonant Acoustic Field Georgia Institute of Technology, Atlanta, Georgia, Oct. 1962 Aeronautical Research Laboratories, Office of Aerospace Research United States Air Force, Wright-Patterson Air Force Base, Ohio.

K. B. M. Q. Zaman, A. Bar-Sever, S. M. Mangalam Effect of acoustic excitation on the flow over a low-Re airfoil J. Fluid Mech (1987), vol. 182, pp. 127-148 NASA Langley Research Center, Hampton, VA 23665, USA.

B. Cukurel, C. Selcan, M. Stratmann, Convective heat transfer investigation of acoustically excited flow over an isolated rib obstacle Intl J Heat Mass Transfer 91 (2015) 848-860.

C. Selcan, B. Cukurel, J. Shashank Heat Transfer Implications of Acoustic Resonances in HP Turbine Blade Internal Cooling Channels Proceedings of ASME Turbo Expo 2015: Turbine Technical Conference and Exposition Jun. 15-19, 2015, Montréal, Canada.

PCT International Search Report and Written Opinion of the ISA, dated Apr. 5, 2016 in PCT/IB2015/059642.

E.J. Rice and K.B.M.Q. Zaman, Control of Shear Flows by Artificial Excitation AIAA—87-2722; AIAA 11th Aeroacoustics Conference, Oct. 19-21, 1987/Palo Alto, California.

K. K. Ahuja and R. H. Burrin, Control of Flow Separation by Sound AIAA—84-2298; AIAA/NASA 9th Aeroacoustics Conference, Oct. 15-17, 1984/Williamsburg, Virginia.

S. Bhattacharjee, B. Scheelke, and T.R. Troutt Modification of Vortex Interactions in a Reattaching Separated Flow AIAA Journal Apr. 1986 vol. 24, No. 4, p. 623-629.

Robert Lemlich and Chung-Kong Hwu The Effect of Acoustic Vibration on Forced Convective Heat Transfer A.I.Ch.E. Journal Mar. 1961 p. 103-106.

L.W. Sigurdson and A. Roshko Control led Unsteady Excitation of a Reattaching Flow AIAA—85-0552; AIM Shear Flow Control Conference, Mar. 12-14, 1985/Boulder, Colorado.

* cited by examiner

ACOUSTIC RESONANCE EXCITED HEAT EXCHANGE

FIELD OF THE INVENTION

The present invention relates to the field of heat exchangers and heat exchange surfaces, especially those in which acoustic resonances are generated in order to improve the thermal efficiency and thermal performance thereof.

BACKGROUND

In the modern technological world many systems require heat to be either added or dissipated towards maintaining their operability and enhancing their thermodynamic efficiency. This change in gas/liquid temperature is typically provided by a heat exchanger, which generally operates by thermally connecting two streams which have a thermal potential difference. Due to form factor limitations associated with many size restrained applications, the state of the art is advancing towards more compact designs. This forms the basis towards higher performance and efficiency heat exchangers—enabling more heat transfer for the same size heat exchanger unit. The term "thermal efficiency" is used in this disclosure to describe the net heat exchange per unit volume of the heat exchanger, while the "performance" is used in this disclosure to describe the net heat exchange achieved per pressure loss in the fluid flow through the heat exchanger unit.

The net total heat exchange can be augmented by increasing the surface area of contact with the cooling surface, but the downside of this is the increased volume of the heat exchanger. In order to enhance the thermal efficiency of conventional designs, in Chinese patent No. CN 102829652 for "High-Efficiency Heat Exchanger based on Infrasonic Wave" to Zhejiang University of Science and Technology, infrasonic waves are proposed for periodic excitation of the tube heat exchanger. In that publication, there is described a tube heat exchanger based on infrasonic waves operating in the region between 4 and 14 Hz. The high-efficiency heat exchanger adopts a boundary layer control mode by infrasonic waves; thereby enhancing the thermal efficiency of the conventional tube heat exchanger. No further details are given in CN 102829652 regarding the physical mechanism behind the operation of this device, but it is believed that traveling waves at the appropriate infrasonic frequency create a viscous layer inside the conventional boundary layer of an attached flow heat exchanger. This then forms the basis of a second order boundary layer phenomenon known as steady streaming, where small amplitude periodic free stream oscillations induce a steady velocity component in the near wall region due to the non-linear boundary layer response. However, for this phenomenon to be relevant, the flow should be attached to the walls of the heat exchanger, as is typical for shell-tube heat exchangers of the type described in CN 102829652, and should not include any boundary layer separation and consecutive reattachment, as encountered in heat exchangers equipped with perturbators.

In the quest for attaining higher thermal efficiencies, compact heat exchangers (CHEs) have been developed, which attempt to provide high heat exchange rates in confined volumes. This can be achieved by means of designs having a large heat transfer surface area per unit of volume, which result in a higher thermal efficiency than more conventional designs such as shell-and-tube. Common CHEs designs include, but are not limited to:

Plate heat exchangers.
Plate-fin heat exchangers.
Printed circuit heat exchangers.
Spiral heat exchangers.

Typically, in contrast to the smooth walls of shell-tube type heat exchangers, the heat exchange surfaces of CHEs are lined with perturbators or turbulators, which have two primary effects—firstly they increase the heat exchange surface "wetted" by the fluid, and secondly—they promote turbulence by locally separating and reattaching the fluid flow to enhance heat transfer to the surface. The latter is generally the dominant process, and such flow turbulence may include the previously mentioned boundary layer separation and consecutive reattachment, which may be considered important features for the improved heat transfer characteristics of CHE's. Reference is now made to FIG. 1A to FIG. 1I, which illustrate several different configurations of perturbators which are used in the flow path over the plate elements of a compact heat exchanger. The drawings show plan views looking down on the flow, and show respectively from FIG. 1A to FIG. 1I, protrusion patterns which are known in the art as 1A—90° continuous rib, 1B—60° parallel broken rib, 1C—60° V-shaped broken rib, 1D—an alternative 60° V-shaped broken rib, 1E—60° parallel continuous rib, 1F—60° V-shaped continuous rib, 1G—conventional zigzag, 1H—S shaped ribs, and 1I—Airfoil shaped ribs. In addition to rib type perturbation elements, pins, fins or dimples can also be used on the plates. The overall thermal performance depends upon the employed perturbation technology, on the geometric configuration of the flow passage including the profiles, height, pitch and angle of any perturbations, on the fluid flow rate, and on the flow channel aspect ratio.

However, there is a design compromise, which constrains the selection of the perturbation technology deployed in the heat exchanger. As a general trend, perturbators more effective in promoting heat exchange tend to further obstruct the fluid flow through the heat exchanger passageways. As a result, a pressure penalty is imposed on the heat exchanger; the more obstructive the employed perturbators, the higher the power of the pump or fan or compressor required to drive the flow past, around or through the perturbations. Therefore, a compromise has to be made between the desired heat exchange and the allowable pressure drop.

Reference is now made to FIG. 2, which is a presentation graph illustrating the performance of a large number of prior art perturbator technologies, as typically employed in commercial compact heat exchangers. The ordinate of the graph shows the Nusselt number Nu of the flow passages, normalized to the Nusselt number $Nu_0$ of a flat plate, namely $Nu/Nu_0$. The abscissa of the graph shows the friction coefficient f of the flow passages, normalized to the friction coefficient $f_0$ of a flat plate, namely $f/f_0$. The points on the graph represent the actual performance of different types of heat exchangers, having different configurations of perturbation elements, if used. The symbols shown correspond to the following configurations of heat exchange surfaces:

x—rib turbulators
Clear triangle—dimple protrusion plates
Filled triangle—pin finned plates
o—dimple-dimple plates
Filled square—swirl chambers
+ sign—plates with roughened surface
●—Dimple-smooth plates
Clear square—Smooth channel The aim of heat exchanger technology is to provide as high a Nusselt number as possible, in order to improve the heat transfer efficiency, and as low a friction coefficient as possible, in order to reduce the pressure drop across the heat exchange path and improve thermal performance. This is shown by the arrows on the axes defining higher thermal exchange efficiency as the Nusselt number rises, and reduced performance in terms of the pressure drop across the heat exchanger path, as the friction coefficient rises. For a prescribed friction coefficient (fixed location on the abscissa), the perturbator configurations corresponding to increased heat transfer enhancement (higher ordinate) relate to superior heat exchange technologies with greater thermal efficiency. However, as a general rule of thumb, increased thermal efficiency comes at the cost of reduced performance as is shown by the gradually rising band of parameters demonstrated in FIG. 2.

In the design process, the heat exchanger configuration in terms of FIG. 2 is selected by determining the heat transfer enhancement required as a function of the acceptable pressure drop generated down the heat exchanger flow path. The performance requirements of the heat exchanger mandates the pressure requirements of the flow mechanism through the heat exchanger, and for any given configuration, a predetermined heat exchange requirement may require provision of the appropriate pressure-generating device.

Therefore, it would be desirable to provide a general upward shift of the performance/efficiency band in order to enhance the operation of the heat exchanger. This can be achieved by a technology providing augmented thermal efficiency without increasing the passage friction accordingly, such that improved thermal efficiency is obtained without the need to increase the input fluid pressure.

The main use of heat exchangers in industry is for extracting heat from surfaces by the relatively cooler fluid flow, and this disclosure has been prepared in terms of such a configuration. However, it should be understood that heat exchangers are also used for their heating function, and this disclosure is not intended to be limited to either one or the other heat transfer functions.

There therefore exists a need for a compact heat exchanger which overcomes at least some of the disadvantages of prior art systems and methods.

The disclosures of each of the publications mentioned in this section and in other sections of the specification, are hereby incorporated by reference, each in its entirety.

SUMMARY

The present disclosure describes new exemplary heat exchange configurations that incorporate internal or external surfaces equipped with perturbators, for changing the thermal behavior of the device or system, or modulating the surface temperature distribution of the surfaces. For an internal flow, this is accomplished without the need to significantly increase the pressure required to achieve the desired through flow, and leaving the volume of the heat exchanger essentially unchanged.

For the local flow separation and reattachment observed in compact heat exchangers equipped with perturbators, it is known that an acoustic wave, which can be infrasound, audible or inaudible, superimposed on top of the constant velocity fluid flow undergoing heat transfer through the passage, has a mostly negligible effect on the thermal efficiency of the heat exchange process. Such acoustic excitation can be fed into the device or system by passing the input flow channel of the heat exchanger through an acoustic wave generator, or by positioning the acoustic source such that the acoustic wave is directly injected onto the flow path. For instance, a loudspeaker can be used to generate the sound, which travels along the heat exchanger path as a traveling wave, together with the fluid flow. Thus, the fluid flow has the traveling acoustic wave superimposed on it, such that any location is subjected to temporal oscillations of higher and lower than the average static pressure, and this periodic change travels down the heat exchanger passages at the speed of sound, which is generally greater than the constant velocity of the fluid flow. However, as stated, it has been observed that the effect of such an acoustic wave on the thermal efficiency of the heat exchanger is very small, if at all present.

One possible explanation for this may be that propagating pressure oscillations arising from the acoustic input travelling down the heat exchanger passageway, do not generate substantial influence on the coherent structures associated with the fluid turbulence. In other words, any potential interaction mechanism of the acoustic waves with the aerothermal flow structure associated with the perturbator in the heat exchanger channel, is spatially "smeared out" and dissipated by the dominant inertial effect associated with the mainstream fluid flow. Thus, the turbulent flow structures generated by perturbators configured across the heat exchange channel, cannot be significantly altered by the traveling pressure wave since, because of its propagation motion, it has no fixed position relative to the geometric location of the perturbator configuration.

A further possible reason for the lack of significant effect of a travelling acoustic wave travelling on the fluid flow down the channel length is that the energy density of the traveling acoustic wave, which constitutes just periodic variations in the pressure, is typically orders of magnitude smaller than the kinetic energy inherent in the fluid flow itself. The minute acoustic-induced flow temperature fluctuations, and associated heat transfer modulation, is in contradistinction to the large heat transfer generated by means of pulsating flow that involves progressive viscous damping of the oscillations by the interaction with the shear layers near the edge of the flow path. In contrast, the energy of the pressure variations of an acoustic wave is both small and virtually unattenuated in its propagation.

In the present disclosure, a method and systems are presented which enable the use of acoustic waves to cause a change in heat transfer from the wetted surfaces of the roughened heat exchange passages to the fluid flowing there through. This alteration can be tailored to enhance or suppress heat exchange, or towards modulating the surface temperature distribution. This aim is achieved by generating a standing wave in the heat exchange passage, by matching the frequency of the exciting wave to a harmonic of the acoustic resonance frequency of the heat exchange passage itself. The term "match" is used in this disclosure to describe that the frequency of the acoustic excitation wave and the resonance frequency of the heat exchange passage are sufficiently close to each other, such that a standing wave is formed in the heat exchange passage.

As the traveling waves interact with the boundaries confining the heat exchange passages, constructive interference of the incident and reflected waves give rise to a spatially-stationary but temporally-oscillating static pressure field, this being the standing wave. By so doing, the comparatively weak energy content of the input traveling acoustic wave can be converted into high amplitude pressure changes at the nodes and anti-nodes of the standing wave within the confines of the heat exchange Thus, the heat exchange passages act as a resonator, and by superimposing this standing wave on the separating and reattaching through-flow, and via the interaction of the stationary pressure oscillations at multiple vortical scales, significant heat transfer modulation can be achieved. Furthermore, the use of a standing wave will provide static positions of increased pressure amplitude regions across the passage, and it is possible that these regions can be intentionally adjusted to have a spatial relationship in regards to the perturbator configuration within. The static locations associated with the standing wave pattern can be operative in coupling with the inherent vortical turbulence scales of the perturbators in the heat exchanger, something which a traveling wave is less able to achieve.

In the case of compact heat exchangers, the present disclosure enables increasing the thermal efficiency and performance of the device. In addition, due to the imposed changes in local heat transfer rate, the surface temperature distribution of heat exchange surfaces can be altered, which can be useful in avoiding hot-spots and spatially minimizing the thermal stresses in the system. The implementation of this method can be through the introduction of active or passive acoustic sources into the flow stream, or via intentionally tailoring the heat exchanger design to match the passageway acoustic resonance frequencies with the naturally occurring acoustic pressure oscillations.

Alternatively, for applications where external flow heat transfer is considered, the same method can be implemented to modulate local heat transfer or vary the location of the hot spots on the perturbed surface. For instance, it is known that the electrical conversion efficiency of photovoltaic cells drop with increased temperature, and the present disclosure enables design of semi-open transparent channels on the sun lit side to be utilized with improved effectiveness.

There is therefore provided, in accordance with an exemplary implementation of the methods and systems of the present disclosure, an exemplary method of changing the thermal behavior of a heat transferring device, comprising (i) providing a heat transferring device with at least one internal passageway having at least one perturbation element and having at least one acoustic resonance frequency when fluid flow is present therein, (ii) generating acoustic wave with frequency matching a harmonic of the at least one acoustic resonance frequency, (iii) applying the acoustic wave to fluid passing through the at least one internal passageway, such that a standing wave is generated in the at least one internal passageway.

In such a method, the at least one perturbation element may comprise at least one surface protrusion or surface indentation that causes the fluid flow to be locally separated and reattached. Additionally, the at least one perturbation element may comprise at least one of a rib, a pin, a fin, a dimple, a pin-fin, or a periodic array of perturbation elements. In yet other implementations of these methods, the at least one internal passageway may comprise at least one channel which enables at least partial through flow and is at least partially bounded by semi-permeable or solid walls. Additionally, the changing of the thermal behavior may arise from the interaction of the standing wave with a separating and reattaching flow of the fluid passing through the at least one internal passageway.

According to other implementations, the at least one acoustic resonance frequency of the at least one internal passageway may be associated with either the entire extent or a portion of the at least one internal passageway, or it may be a plurality of acoustic resonance frequencies, the frequencies being associated with different segments of the at least one internal passageway. Furthermore, the acoustic waves may be applied to the fluid on at least one of an input port, an output port or at any other position of the passageway.

Alternative implementations include a method of changing the thermal behavior of heat transferring device, comprising providing a heat transferring device with at least one internal passageway having at least one perturbation element, the internal passageway is constructed to have at least one acoustic resonance frequency when fluid flow is present therein, such that a harmonic of the resonance frequency is matching an acoustic wave frequency derived from a source of pressure fluctuations, such that a standing wave is generated in the at least one internal passageway.

In such a method, the at least one perturbation element may comprise at least one surface protrusion or surface indentation that causes the fluid flow to be locally separated and reattached. Additionally, the at least one perturbation element may comprise at least one of a rib, a pin, a fin, a dimple, a pin-fin, or a periodic array of perturbation elements. In yet other implementations of these methods, the at least one internal passageway may comprise at least one channel which enables at least partial through flow and is at least partially bounded by semi-permeable or solid walls. Furthermore, the changing of the thermal behavior may arise from the interaction of the standing wave with a separating and reattaching flow of the fluid passing through the at least one internal passageway.

According to further implementations, the at least one acoustic resonance frequency of the at least one internal passageway may be associated with either the entire extent or a portion of the at least one internal passageway, or it may be a plurality of acoustic resonance frequencies, the frequencies being associated with different segments of the at least one internal passageway. Furthermore, the acoustic waves may be applied to the fluid on at least one of an input port, an output port or at any other position of the passageway.

In an even further method described in this disclosure, there is provided a method of changing the thermal behavior of a heat transferring device, comprising (i) providing heat transferring device comprising an external channel, which is open on at least one side and having at least one perturbation element, the external channel is having at least one acoustic resonance frequency when fluid flow is in contact with the external channel (ii) utilizing a source for generating acoustic wave with frequency matching a harmonic of the at least one acoustic resonance frequency of the external channel wherein the acoustic wave is applied to the contacting fluid flow, such that a standing wave is generated in the external channel to effect the heat transfer.

In this even further method, the at least one perturbation element may comprise at least one surface protrusion or surface indentation that causes the fluid flow to be locally separated and reattached. Additionally, the at least one perturbation element may comprise at least one of a rib, a pin, a fin, a dimple, a pin-fin, or a periodic array of perturbation elements. In yet other implementations of these even further methods, the at least one internal passageway may enable at least partial through flow and may be at least partially bounded by semi-permeable or solid walls. Furthermore, the changing of the thermal behavior may arise from the interaction of the standing wave with a separating and reattaching flow of the fluid passing through the at least one external channel.

According to further implementations of these even further methods, the at least one acoustic resonance frequency of the at least one external channel may be associated with either the entire extent or a portion of the at least one external channel, or it may be a plurality of acoustic resonance frequencies, the frequencies being associated with different segments of the at least one external channel. Furthermore, the acoustic waves may be applied to the fluid on at least one side of the at least one external channel.

There is further provided according to any of the above mentioned methods, a method which enables modulation of the surface temperature distribution of the at least one internal passageway or external channel. Also, the at least one acoustic resonance frequency may be a harmonic of any of a longitudinal, transverse, lateral, radial, or mixed mode(s) of standing wave(s) created. Additionally, the acoustic resonance frequency may be the fundamental resonance frequency or a harmonic of the fundamental resonance frequency, and furthermore, it may be in the audible, the inaudible, the infrasound or the ultrasound frequency ranges. These acoustic waves may be generated by at least one externally powered source, and in that case, at least one externally powered source may produce temporal acoustic pressure fluctuations through vibroacoustics or thermoacoustics. Alternatively, the acoustic waves may be passively generated, and if so, may be generated by any combination of at least one of a fluid-dynamic, fluid-resonant, or fluid-elastic generator. Finally, they may also arise from externally occurring pressure fluctuations.

According to yet a further implementation of this disclosure there is provided a heat transferring device, comprising (i) at least one internal passageway, having at least one perturbation element, and having at least one acoustic resonance frequency when fluid flow is present in the internal passageway (ii) a source for generating acoustic wave with frequency at harmonic of the at least one acoustic resonance frequency, the acoustic source configured to apply the acoustic wave to a fluid passing through the at least one internal passageway, such that a standing wave is generated in the at least one internal passageway.

In such a heat transferring device, the at least one perturbation element may comprise at least one of a rib, a pin, a fin, a dimple, or a pin-fin, or it may comprise a periodic array of perturbation elements. Furthermore, the acoustic source may be either or both of an externally powered device or a passive device.

Yet another implementation describes a heat transferring device, comprising at least one internal passageway for passing fluid therethrough, having at least one perturbation element, wherein the at least one internal passageway is constructed to have at least one acoustic resonance frequency when fluid flow is present therein, such that a harmonic of the resonance frequency is matching an acoustic wave frequency derived from a source of pressure fluctuations, such that a standing wave is generated in the at least one internal passageway.

In this other implementation, the at least one perturbation element may comprise at least one of a rib, a pin, a fin, a dimple, or a pin-fin, or it may comprise a periodic array of perturbation elements.

Other exemplary implementations may further involve a heat transferring device, comprising (i) an external channel, which is open on at least one side and having at least one perturbation element, the external channel is having at least one acoustic resonance frequency when fluid flow is in contact with the external channel (ii) a source for generating acoustic wave with frequency matching a harmonic of the at least one acoustic resonance frequency of the external channel, wherein the acoustic wave is applied to the contacting fluid flow, such that a standing wave is generated in the external channel to effect the heat transfer.

In this other heat transferring device, the at least one perturbation element may comprise at least one of a rib, a pin, a fin, a dimple, or a pin-fin, or it may comprise a periodic array of perturbation elements. Furthermore, the acoustic source may be either or both of an externally powered device or a passive device.

Finally, according to yet another implementation, there is provided a turbine blade, comprising (i) at least one internal cooling passageway equipped with at least one perturbation element, wherein the cooling passageway is constructed to have at least one acoustic resonance frequency when fluid flow is present therein, such that a harmonic of the resonance frequency is matching an acoustic wave frequency derived from a source of pressure fluctuations, such that a standing wave is generated in the at least one internal cooling passageway to locally enhance heat transfer.

In this yet another implementation of a turbine blade, the at least one perturbation element may comprise at least one of a rib, a pin, a fin, a dimple, or a pin-fin, or it may comprise a periodic array of perturbation elements.

BRIEF DESCRIPTION OF THE DRAWINGS

The present invention will be understood and appreciated more fully from the following detailed description, taken in conjunction with the drawings in which:

—FIG. 6A shows the channel geometry, FIGS. 6B and 6C show the estimated Nusselt numbers along the flow path, with and without acoustic resonance excitation, and FIG. 6D shows the heat transfer enhancement effect associated with acoustic resonances;

DETAILED DESCRIPTION

Figure 3:
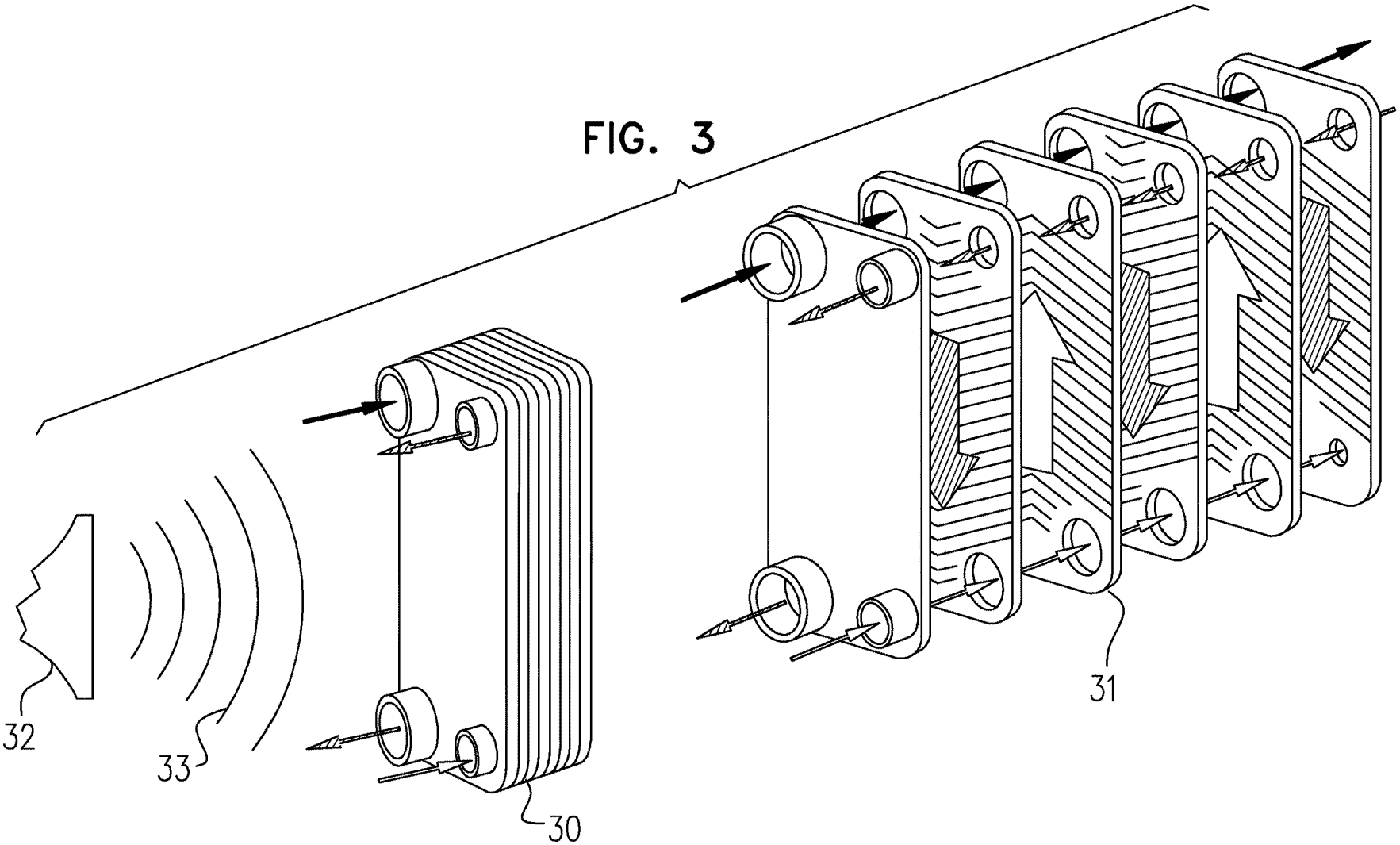
FIG. 3 illustrates schematically an exemplary heat exchanger showing additional acoustic elements suitable for implementing the methods of the present disclosure for increasing the thermal efficiency of the heat exchange.
Figure 4A:
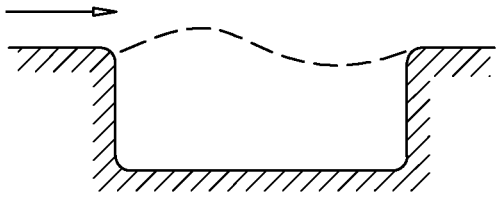
FIGS. 4A to 4D show some sample cavities, which can be used for passive excitation or self-excitation of the fluid input to the heat exchanger of FIG. 3.
Figure 4B:
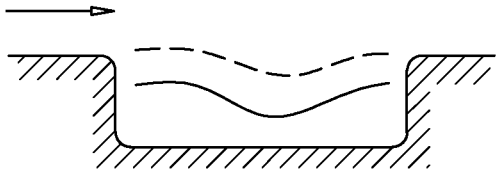
Figure 4C:
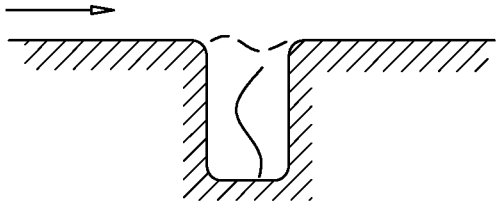
Figure 4D:
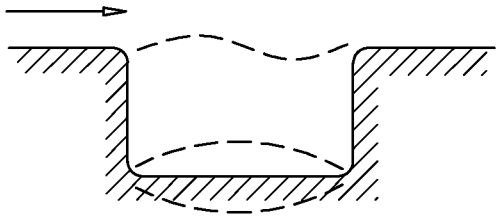

Reference is now made to FIG. 3, which illustrates schematically an exemplary heat exchanger 30 showing additional acoustic elements suitable for implementing the methods of increasing the efficiency of a heat exchanger by using periodic acoustic excitation with acoustic waves tuned to the acoustic resonance frequency of the heat exchanger passageways. The exemplary heat exchanger shown in FIG. 3 is a roughened plate heat exchanger 30, which is shown on the right-hand side of FIG. 3 with its plates disassembled to show the passage of the fluid through the heat exchanger and across the roughened plates 31. An acoustic source 32 is used to inject acoustic waves 33 into the input manifolds of the heat exchanger, either by passing the flow through the acoustic source 32, or by directing the acoustic wave to impinge on the fluid, such that the sound pressure changes are imposed upon the flow. A loudspeaker can be used for such acoustic wave generation. The frequency of the acoustic excitation source is tuned to be the same as the acoustic resonance frequency of the heat exchanger passage or passages. Therefore the traveling wave 33 generated by the excitation source 32, on entry into the heat exchanger 30, establishes a standing wave pressure pattern, and such a standing wave pattern can have pressure amplitudes substantially larger than that of the input wave itself, in accordance with the acoustic Q-factor of the "resonant cavity" of the heat exchanger passageways.

In the plate-type heat exchanger 30 shown in FIG. 3 it is possible to position an acoustic excitation source in either the hot flow stream or the cold flow stream or both, and to analyze the acoustic resonance of each stream independently. The resonance frequency depends on the working fluid and the temperature of the fluid within the flow path, since the speed of sound differs with the temperature of the medium through which the sound is passing. The source 32 generates a traveling propagating wave 33 outside of the heat exchanger cavity, having a frequency calculated to be the same as that of the resonance of the heat exchanger path, but on entering the heat exchanger cavity, generates a standing wave in accordance with the geometry, length, and form of the passageways of each section of the heat exchanger.

The system of FIG. 3 shows an active excitation source. However, a more convenient way of achieving traveling pressure waves may be by using a passive excitation source rather than an active excitation source. The passive excitation source will have an output tone which can itself be tuned to the resonance frequency of the heat exchanger cavity, and can be self excited at the correct frequency without any input tone being applied. In other words, the steady fluid flow through the passive excitation source generates an acoustic tone at the same frequency as the self-resonance of the heat exchanger cavity. Thereafter, the acoustic wave is carried through the flow into the cavity of the heat exchanger, such that the produced standing wave is self-maintaining without any external input to generate the wave form.

Reference is now made to FIGS. 4A to 4D, which show some sample means of creating acoustic waves which can be used for passively exciting the fluid in the heat exchanger. These drawings show respectively a simple cavity, a shallow depth cavity and a deep cavity, and a cavity with a vibrating component that produce the acoustic source excitation by means of fluid-dynamic, fluid-resonant, and fluid-elastic interactions.

Figure 5:
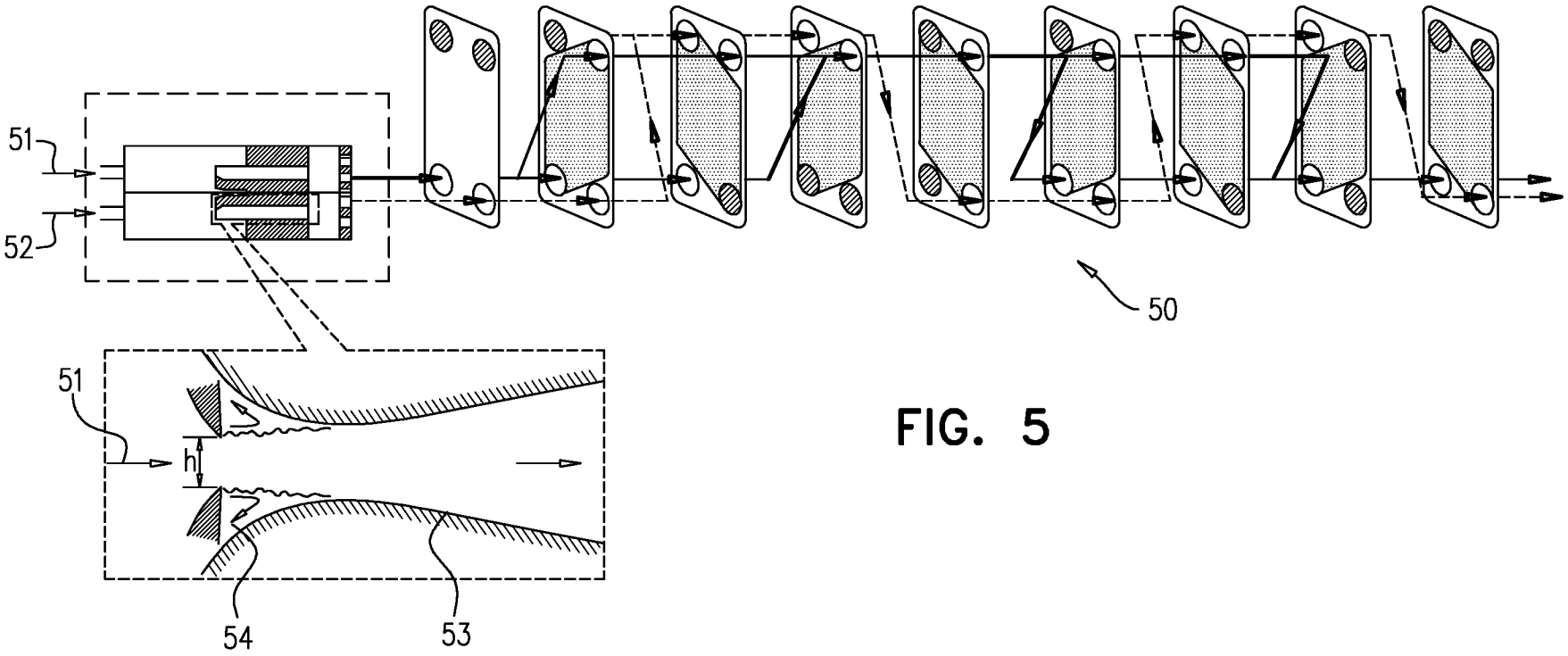
FIG. 5 illustrates schematically a standard solar plate heat exchanger with passive excitation inputs, to achieve a higher heat transfer efficiency.

Reference is now made to FIG. 5, which illustrates schematically a standard solar plate heat exchanger 50, with its plates disassembled in order to show the separate hot and cold fluid flow paths, adapted according to the methods of the present disclosure to achieve a higher heat transfer efficiency than a conventional design. In the entry flow paths 51,52, of the heat exchanger, there are positioned passive acoustic excitation sources, shown in FIG. 5 as acoustic horns 53. An enlarged cross-sectional view of such a horn resonator 53 is shown in the blown up section of the drawing. The flow 51 through the horn 53 generates an acoustic wave because of the resonance in the vibrating flap cavity 54, as is known in a conventional horn. By this means, the acoustic wave is generated in the horn 53 by the flow 51 itself, and impressed upon the fluid before entry into the heat exchanger 50. The resonance frequency of the horn is adapted to be equal to a resonance frequency of one or more passageways in the heat exchanger, such that the impressed acoustic wave generates a standing wave within the aforesaid passageways. The resonance frequency can either be selected to be that of the entire passageway of the heat exchanger, or it can be tuned to be that of a certain section of the passageway of the heat exchanger, where for instance more efficient heat transfer is required because of a localized heating problem inherent to the design. In addition, based on the internal features of the heat exchanger, the generated excitation frequency can be designed to be at any overtone (higher harmonic) of the fundamental (base resonance) frequency of the longitudinal, transverse, lateral, radial (but not limited to) and mixed modes of resonance. As previously stated, the passive resonator, such as the horn 53, can be positioned in either the hot or the cold fluid flows, or in both as is shown in FIG. 5.

The configuration shown in FIG. 5 is particularly convenient, since it enables the improvement of existing heat exchangers to be achieved by the simple addition of such passive resonators at the input or output manifold(s) of the heat exchanger, without the need to modify the heat exchanger elements themselves. Moreover, in the presence of a change in inlet or outlet fluid temperature supply, the tonal sound generation will be self-adapted to match with the changed acoustic resonance frequency of the heat exchanger passages. Furthermore, the robust design of such a passive resonator is such that it can withstand the hot gas environments present, which may be destructive to other methods of generating an acoustic wave. In addition such a passive resonator does not present any significant obstruction to the fluid flow, such that the kinetic efficiency of the heat exchanger is not affected.

Figure 1A:
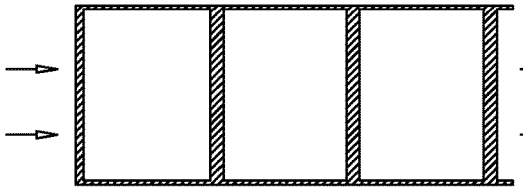
FIG. 1A to FIG. 1I illustrate several different configurations of rib perturbations used in the flow path of the plate cooling elements of a compact heat exchanger.
Figure 1B:
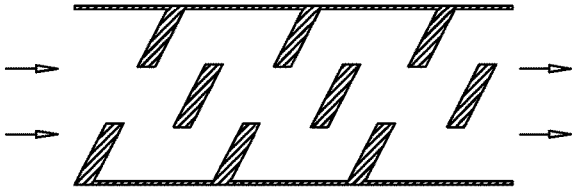
Figure 1C:
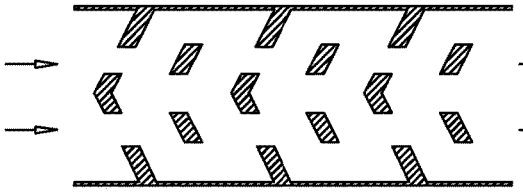
Figure 1D:
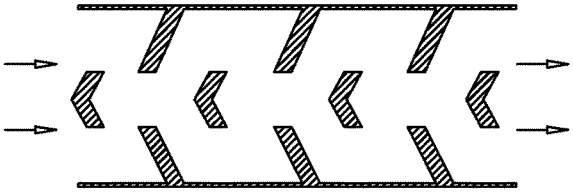
Figure 1E:
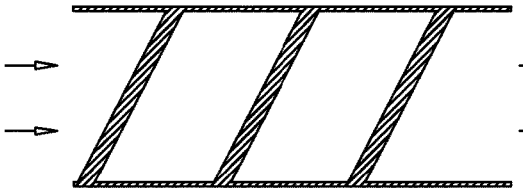
Figure 1F:
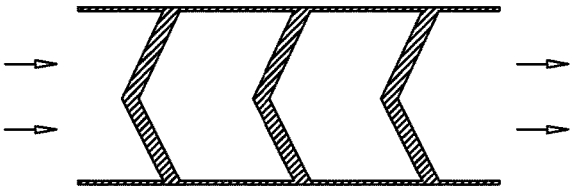
Figure 1G:
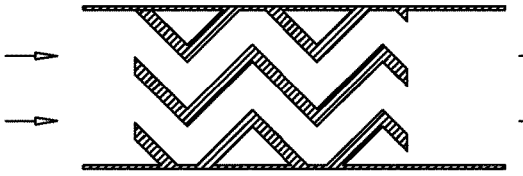
Figure 1H:
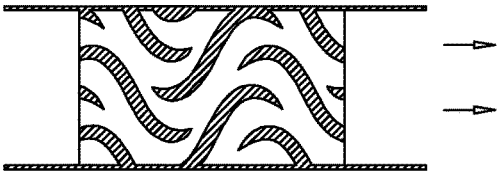
Figure 1I:
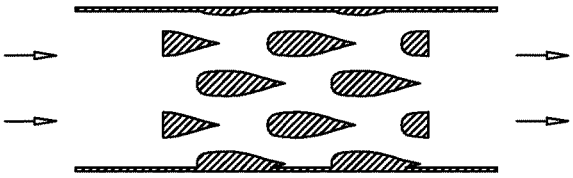
Figure 2:
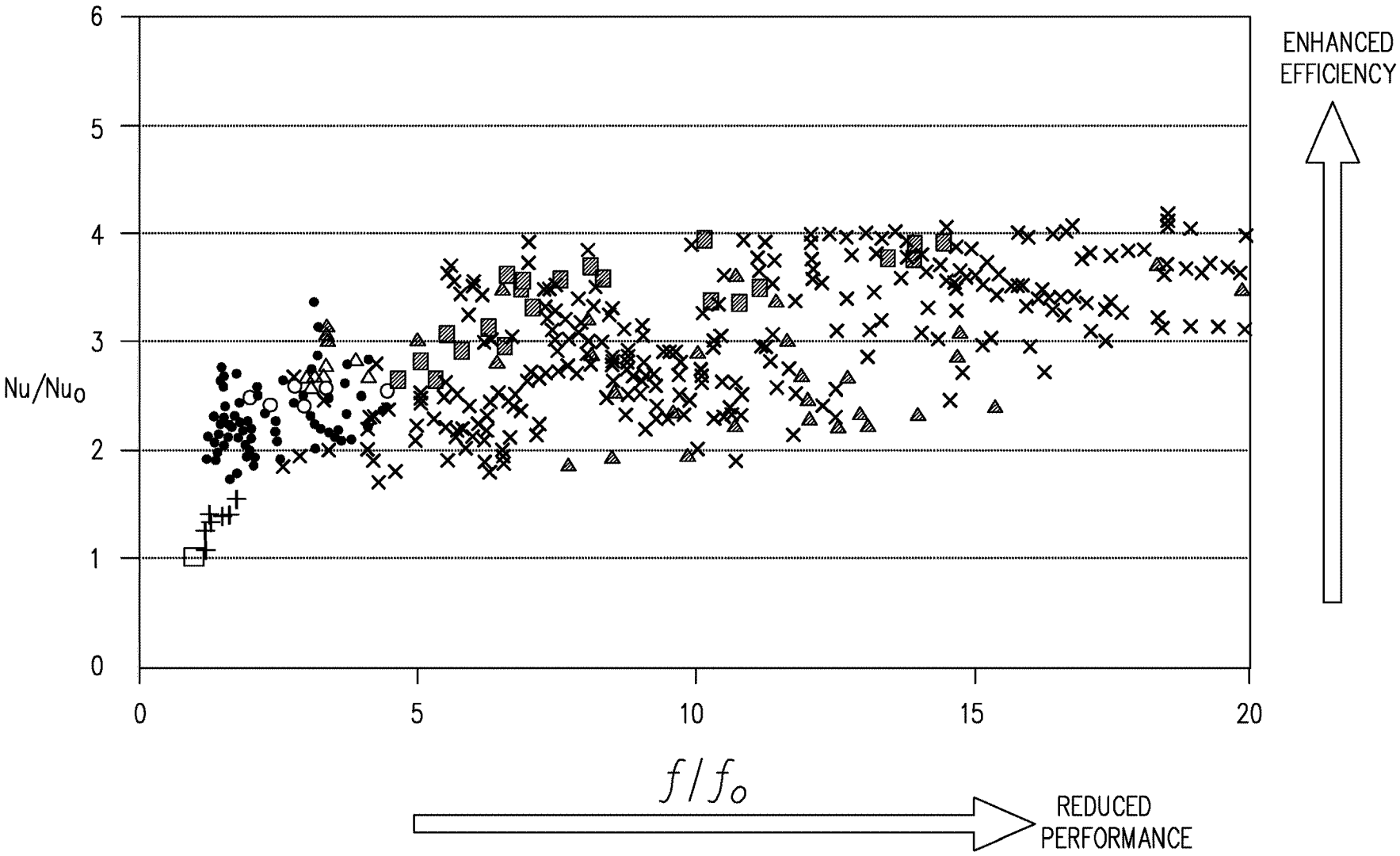
FIG. 2 is a presentation graph illustrating the performance of a large number of prior art perturbator technologies, typically employed in commercial compact heat exchangers.

The adapted heat exchanger of FIG. 5, or similar systems constructed according to the methods of the present disclosure, thus provides enhancement of the thermal performance and efficiency of the heat exchanger. Alternatively, for the same thermal efficiency as a prior art heat exchanger of the same type, use of these methods would correspond to a reduction in the form factor and size of the heat exchanger. Use of the methods and systems of the present disclosure therefore enables the performance characteristic band of the heat exchangers shown in the graph of FIG. 2 to be moved upwards, indicating an increase in the thermal efficiency compared to prior art heat exchangers. An increase of up to 30% in the thermal efficiency of such heat exchangers has been shown to be readily achieved, even using unoptimized designs generated during feasibility tests of these systems.

Figure 6A:
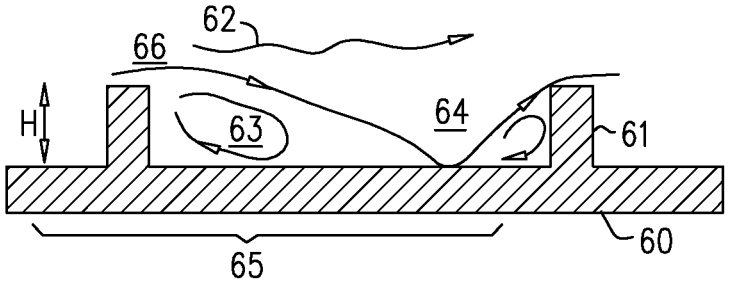
FIGS. 6A to 6D illustrate experimental wind tunnel results on a rib turbulator section of a heat exchange passage, showing the enhancement of the thermal efficiency when longitudinal acoustic excitation is applied

Reference is now made to FIGS. 6A to 6D, which illustrate some experimental wind tunnel results, showing how it is believed that the enhancement in heat exchanger thermal efficiency is achieved, when the methods of the present disclosure are applied to a heat exchange passage equipped with a rib turbulator. FIG. 6A shows the basic topology in a cross-sectional view of a ribbed plate rectangular section of such a heat exchanger. The channel wall plate 60 of the heat exchanger has a number of rib perturbators 61 having a predetermined height H and pitch according to the design of the channel. As is known in the art from aerodynamic analysis of ribbed channels, the fluid flow 62 over such ribs 61 is highly turbulent 62, and the ribs generate flow separation in the region 66, with flow reversal 63 occurring in the rib wake region, and reattachment 64 at a distance from the rib; further downstream, the turbulence generating process is repeated as the next rib is encountered. The standing waves of the methods and systems of the present disclosure can be adjusted to generate increased turbulence, or coherent structures, or recirculation, at the optimal points relative to the rib, resulting in enhanced heat transfer because of the acoustically improved mixing generated by the perturbator.

Figure 6B:
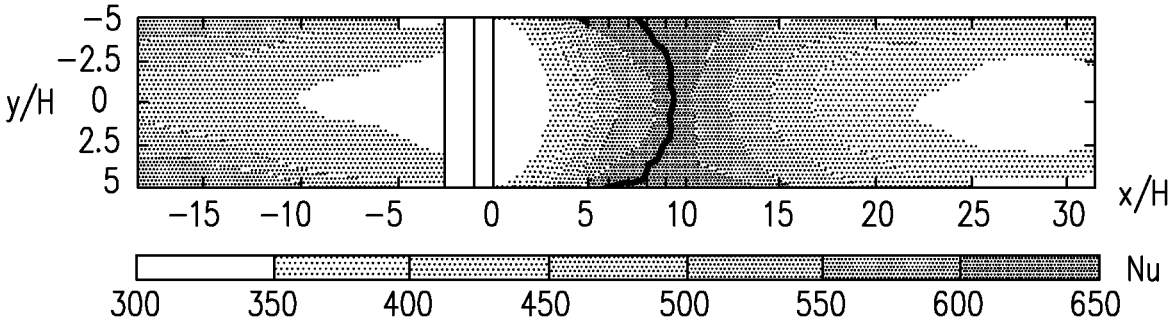
Figure 6C:
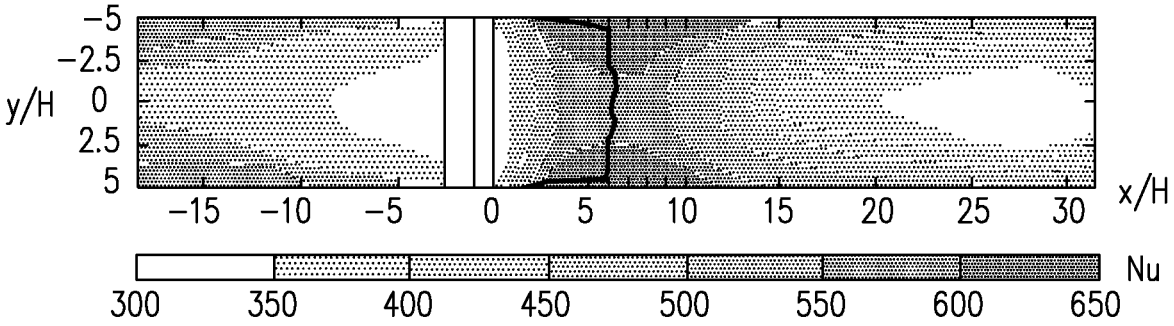

FIGS. 6B and 6C are graphic representations of the heat transfer distributions in the region 65 of the rib configuration of FIG. 6A, as obtained in wind tunnel experiments, where the rectangular heat exchange channel is subjected to Reynolds number of $Re_D$=134,000 and $Re_H$=10,050, based on channel hydraulic diameter and rib height respectively. The heat transfer is represented by the Nusselt numbers Nu, measured along the ribbed plate channel of the heat exchanger. The representations are of a plan view of the channels, looking down onto the ribs, such that y is the position across the width of the channel, and x is the distance down the channel, both being normalized to H, the rib height. FIG. 6B shows the values obtained in a prior art, unexcited heat transfer configuration, used as the baseline measurement, while FIG. 6C shows the values obtained in a heat transfer configuration according to the present disclosure, in this case implementing longitudinal acoustic resonance excitation. An analysis of these two representations is useful in explaining what is believed to be the reason for the enhanced thermal transfer achieved by the systems of the present disclosure. However it is to be understood that the methods and systems of the present disclosure are not intended to be dependent on the proposed mechanisms responsible for the achievements of the improvements described herewithin, and that other explanations may be the reason for the results obtained.

An analysis is now made of the baseline results of FIG. 6B. As a preliminary note, it is observed that no heat transfer data is available on the top and directly upstream of the rib, in the region $-2.33<x/H<0$, due to the blocked camera observation path associated with the thermal measurement. The local streamwise maximum in heat transfer, $x_{max}$, is indicated by the thin black line crossing the channel in the region of x/H=9.

The upstream region $-19<x/H<-2.33$ is characterized by the unperturbed boundary layer development over a flat plate 60, prior to influence due to the presence of the rib obstacle 61. Associated with boundary layer thickening at increasing development length from the inlet, an overall gradual decrease in heat transfer is observed. Towards the lateral walls, higher levels of heat transfer are a result of the corner wall vortices associated with the rectangular channel flow geometry.

As the flow approaches the rib, $-2.33<x/H<0$, it undergoes a deviation imposed by the obstacle. Passing over the rib, the flow is locally accelerated and subsequently experiences an abrupt step change at the backward face of the rib. Forming an elongated recirculation bubble 63, and confined by the flow reattachment line, the separated flow region occupies a distance of approximately 8-10H, as shown in FIG. 6B. As the most prominent flow feature, this exerts large variations in heat transfer.

Forming a low momentum zone, the rib wake separation bubble imparts a local minimum in Nusselt number $Nu_D$=370 at the immediate vicinity of the rib, x/H=0. This is evident across the entire passage width (x/H). Further downstream of the rib from x/H~1.5, the Nusselt number begins to increase monotonously as cooler flow is progressively entrained from the mainstream—a consequence of the diminishing wake effects. At an increased axial position, this steep rise eventually reaches a global maximum (Nu~580) in the vicinity of the reattachment point, where the strong impingement of the separated free shear layer on the bounding wall subjects the heated surface to cool high-momentum mainstream fluid. Although the aerodynamic reattachment point ($x_R$) and streamwise maximum in heat transfer ($x_{max}$) do not universally coincide for all separated flows, $x_{max}$ is considered to be a relevant indicator of the skin friction reversal point. Towards the side walls, the local heat transfer maxima levels increase, the locations of which are observed slightly further upstream. This curved spanwise distribution and laterally increasing heat transfer are attributed to the aerodynamic wall effects and rolled up corner vortices, being advected over the rib from the upstream separation point. Beyond the reattachment point, x/H>10, the heat transfer decreases monotonically in the streamwise direction with the redeveloping thermal boundary layer and eventually approaches its initial unperturbed boundary layer state, at approximately x/H>27.

In order to investigate the heat transfer implications of the acoustic resonance excitation of the present application, in FIG. 6C there is shown the flow over a rib 61, subjected to harmonic 120 Hz acoustic forcing. This frequency corresponds to the acoustic resonance frequency of the channel shown in FIG. 6A on which the results of FIGS. 6B to 6D were obtained. The resulting distributions of Nusselt number are displayed in FIG. 6C. Compared with the baseline unexcited case in FIG. 6B, significant changes associated with the acoustic perturbations are visible in FIG. 6C. To highlight this, the longitudinal Nu variation at the centerline position of the channel is portrayed in the presence and absence of 120 Hz resonance excitation, in FIG. 7, hereinbelow. The points of local maximum heat transfer for both cases are indicated in FIG. 7 by a triangle.

Figure 7:
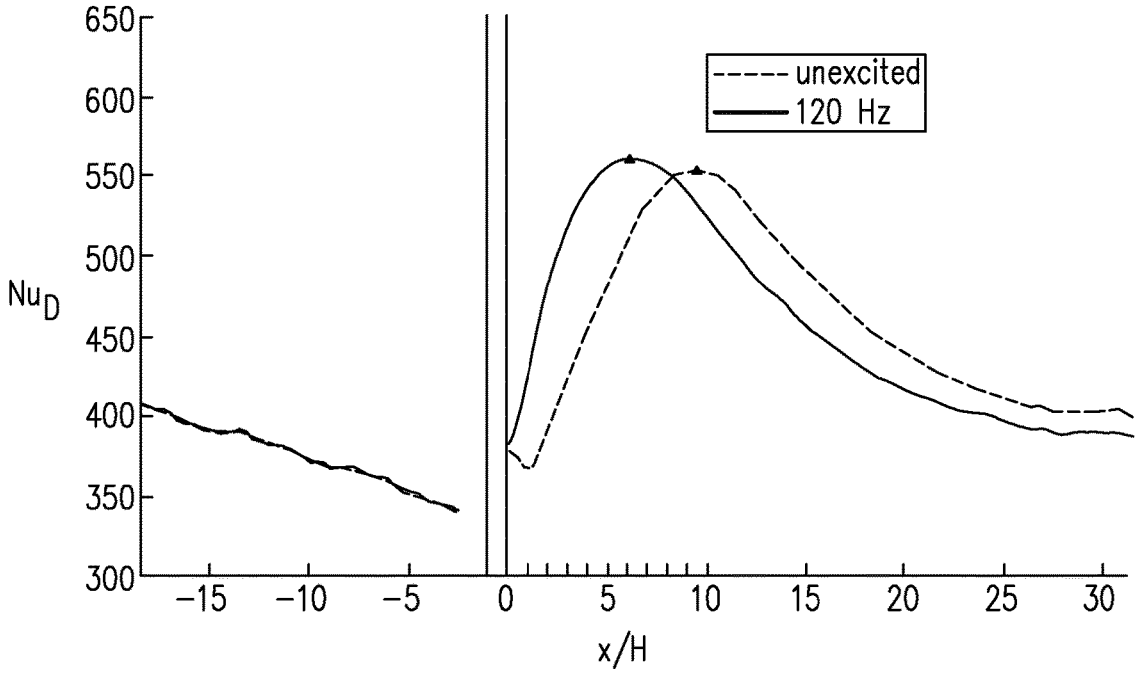
FIG. 7 is a graph showing the longitudinal Nu variation at the centerline position of the channel shown in FIGS. 6B and 6C, in the presence and absence of the acoustic resonance excitation.

Regions upstream of the rib, $x/H<-2.33$, feature flat plate boundary layer development, and appear to be impervious to acoustic excitation, as shown by the co-incident traces in the graph of FIG. 7. As opposed to this, downstream of the step disturbance and around the reattachment region, $0<x/H<15$, as is seen in FIG. 6C, the sound forcing excitation has a significant effect on the local flow field and the associated heat transfer distribution. While the local minimum in heat transfer remains fixed at the rib back face, x/H=0, the steep streamwise gradient in the separation region appears to be augmented as a consequence of the sound excitation, as is seen in the steeper and spatially earlier rise of the Nusselt number for the excited curve of FIG. 7. An increase in maximum heat transfer level is observed. Reaching an earlier reattachment, the extent of the bubble is significantly reduced under the influence of acoustic excitation, shifting the location of centerline maximum heat transfer from $x_{max}/H$=9.5 to $x_{max}/H$=6. Towards the lateral walls at $y/H\geq3.33$, a similar observation can be made, moving $x_{max}/H$ from 8.5 to 6, as seen in FIG. 6C. Therefore, while the line of unexcited flow reattachment shown in FIG. 6B exhibits a curved shape in the spanwise direction, it becomes flattened in the presence of sound excitation.

It appears that the 120 Hz acoustic resonance excitation exerts attenuating influence on the extent of the rib wake separation, notably reducing the size of this prevalent flow structure. Therefore, together with the characteristic flow topology, the associated heat transfer pattern is shifted towards the rib and compressed in the streamwise direction. Further downstream, as the excited thermal boundary layer starts to develop at an earlier position, the local heat transfer level at the re-attached flow condition appears to be slightly lower with respect to the unexcited case of FIG. 6B.

Figure 6D:
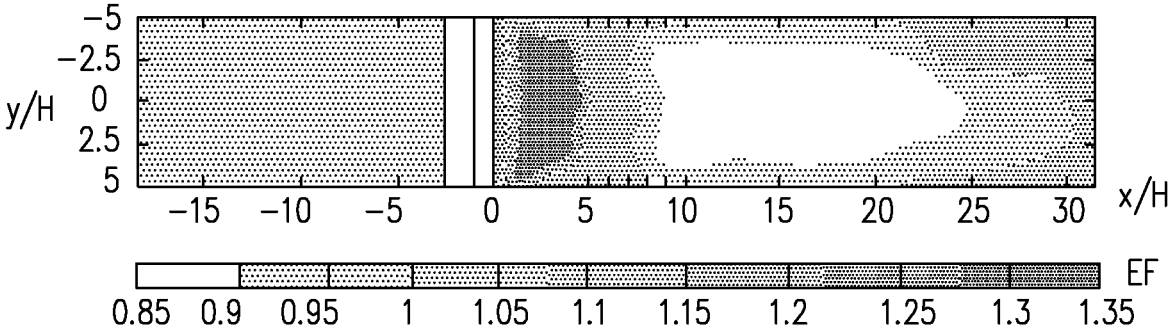

Reference is now made to FIG. 6D, which shows the acoustically-associated enhancement factor, EF, contrasting the excited case of FIG. 6C to the unexcited case of FIG. 6B. Upstream of the rib, indicated by uniform EF~1, effects of acoustical excitation are notably absent. In the immediate wake of the fence (x/H=0-8), due to upstream shift of the bell shaped Nusselt curve, as shown in the graphs of FIG. 7, pronounced heat transfer augmentation is observed over the entire span of the channel. With a maximum around the centerline at x/H~1.5 and |y/H|<2.5, the enhancement factor exhibits an increase up to 25%. This alteration is not as prominent towards the lateral side walls. Further downstream, the heat transfer enhancement decreases gradually. Decaying to zero slightly upstream of the unexcited reattachment point (x/H=8), it reaches a global minimum at x/H=12.5. Far away from the obstacle, the EF gradually re-approaches unity, and therefore the sound induced effects are observed to diminish.

Figure 8:
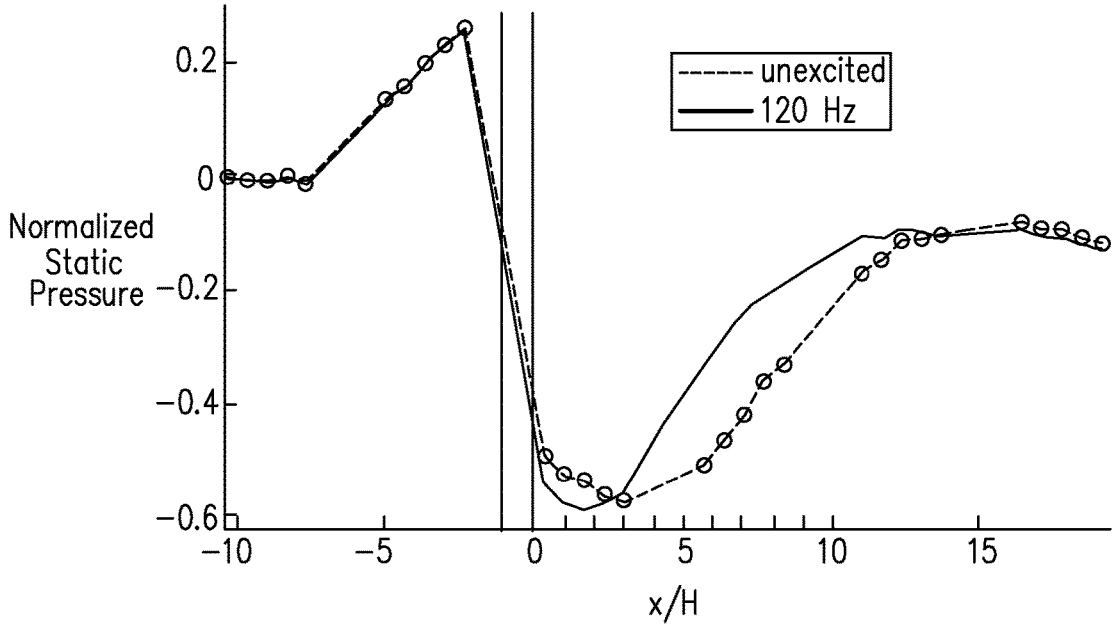
FIG. 8 shows graphically the static wall pressure data for the unexcited and the acoustic resonance excited cases of FIGS. 6B and 6C.

Reference is now made to FIG. 8, which, in order to assess the local pressure drop implications of acoustic forcing on the rib wake, shows graphically the static wall pressure data for the unexcited and excited cases of FIGS. 6B and 6C. FIG. 8 shows the pressure development along the channel centerline acquired over a distance of 30 rib heights. As an indicator of aerodynamic losses, the static wall pressure acquisition enables representation of aerodynamic flow separation and reattachment. To this end, normalized by the dynamic pressure head, the values are reported in reference to the pressure port upstream of the rib at x/H=−10.

The static pressure ahead of the fence is seen to exhibit a development which is typical for the mean flow topology in the presence of an obstacle. As the flow encounters the perturbator, −8>x/H>−1, the initially streamwise constant static pressure rises due to the potential blockage effect. Consistent with the results shown in FIG. 6C, sound excitation is seen as not imposing any changes to the local pressure field, supporting the observation that the oncoming attached upstream boundary layer is unaffected by the acoustic forcing.

In contrast, notable excitation effects are apparent in the fence downstream region, 0<x/H<13.5. Absent of forcing, the wall pressure in the separation zone initially reduces in the streamwise direction and reaches a global minimum at x/H=3. Thereafter, wall pressure exhibits a gradual rise with constant slope until shortly after the reattachment point, x/H=12.5. Further downstream, the curve maintains a relatively constant level in the redeveloping flat plate boundary layer. The integral pressure drop penalty incurred over the fence obstacle is characterized by a D'Arcy friction factor of around f=0.14.

In the presence of the excitation, although the general trends are retained, there seems to be a greater initial drop in pressure in the immediate vicinity of the rib, followed by an earlier minimum in pressure at x/H=1.5. In comparison to the unexcited case, the initial rise is observed to be steeper than the prior observed linear trend. Downstream of the excited maximum heat transfer point ($x_{max}$/H=6.5), the pressure gradient drops gradually. Remarkably, the identical plateau of downstream static pressure level is reached at around the same location, x/H=12.5. Therefore, the total pressure loss associated with flow over the fence is inferred to remain constant. This is an important result, since it means that the increased thermal transfer efficiency of the systems of the present disclosure is achieved essentially without any additional pressure penalty on the flow driving system.

Regarding the invariance of static pressure downstream of the separation region both absent and present of forcing, it can be deduced that the associated aerodynamic loss mechanism is unaffected despite prominent excitation induced changes in the reattachment region. As it is primarily the recirculation bubble, which causes the pressure drop, the associated recirculation (integral vorticity) can be hypothesized to remain constant. For the conducive excitation, the slightly lower initial pressure at the rib back face, along with the earlier recovery, could be indicative of a smaller vortex of greater vorticity, rotating at a higher rate, immediately downstream of the rib.

At the edge of the rib separation, the mixing layer dynamics are assumed to be governed by shear-induced generation of vorticity and turbulence in the velocity gradient region. The instability may roll up into vortices and could give rise to ensuing development of large coherent structures via sequential vortex pairing and amalgamation. After initial laminar formation, the increasing scales of these quasi-deterministic 'building blocks' could determine the entrainment of momentum into the shear layer and thus the extent of turbulent mixing. Therefore, the downstream thickening or 'spreading rate' of the mixing layer may be related to the vortex pairing mechanism and could be associated with the growth rate of large spanwise-correlated vortical structures. The spatially stationary periodic fluctuation of a standing wave could either directly interact with the pre-existing coherent flow feature, or form a new structure to dominate the reattaching flow field. Through the use of pressure nodes and velocity antinodes, standing waves can therefore be considered an effective way of delivering the necessary perturbation in the desired location and direction; and thereby influencing the heat exchange mechanisms on the channel surface.

Figure 9B:
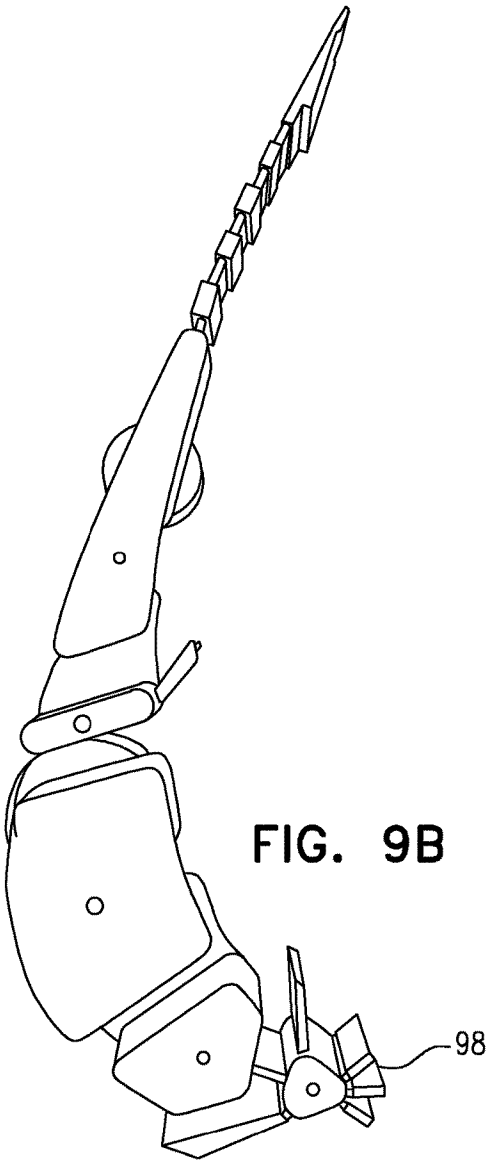
FIGS. 9A and 9B illustrate schematically two views of the internal cooling channels of a typical high pressure turbine blade.
Figure 9A:
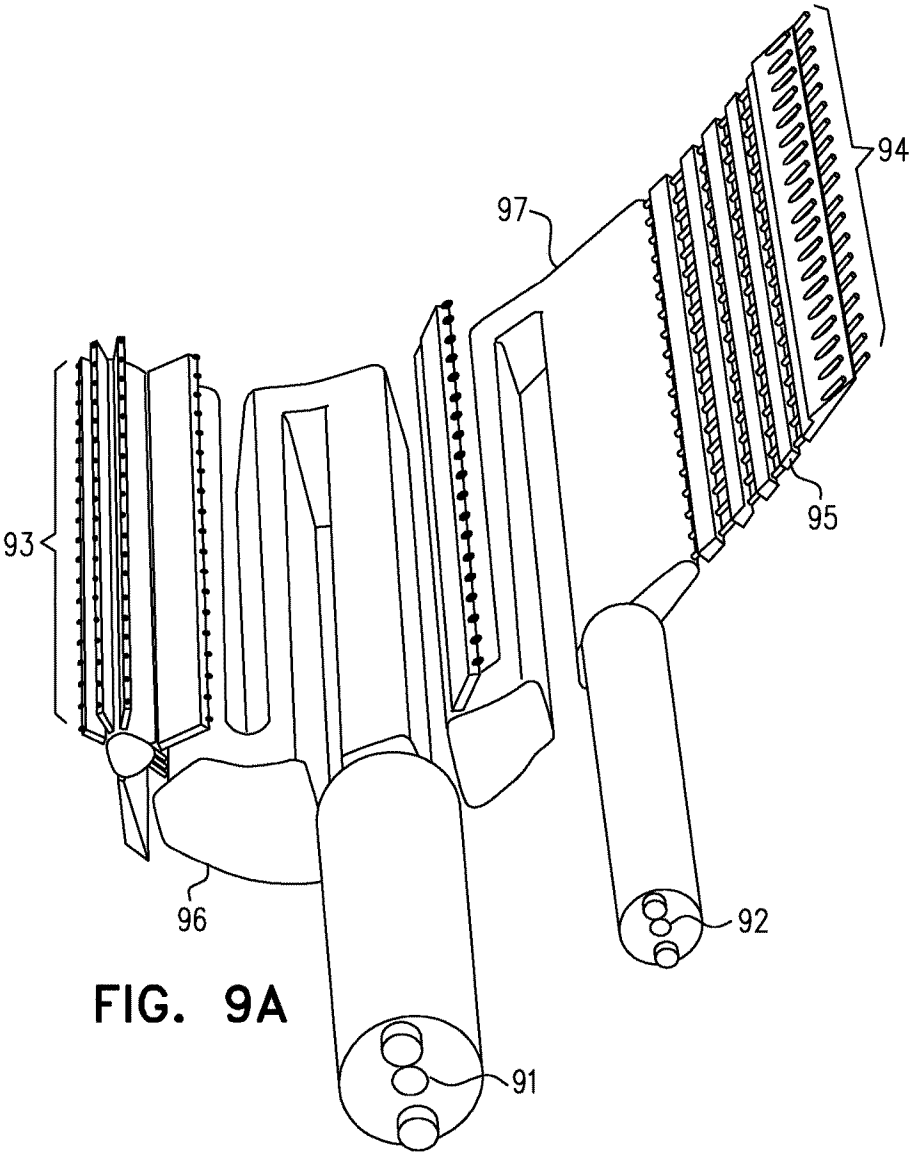

Reference is now made to FIGS. 9A and 9B, which illustrate schematically two views of the internal cooling channels of a high pressure turbine blade, based on the geometry of the NASA/GE Energy Efficient Engine ($E^3$) engine. In such blades, in order to keep the turbine vane and blade metal temperatures below allowable limits, internal cooling techniques route the compressor air, introduced from the blade roots 91,92, through intricate serpentine passages, the front serpentine 96, and the aft serpentine 97, inside the airfoil. Extracting heat from the rectilinear internal channel walls, the gas is eventually discharged into the main stream from the leading edge film cooling holes 93 located in the leading edge showerhead 98, from the trailing edge film cooling slots 94, and the blade tip. The trailing edge impingement cavities 95 also assist in heat dissipation.

To promote heat exchange, the passage walls are lined with repeated geometrical disturbance elements, which yield improved mixing with the free stream and induce high levels of turbulence to the core flow. This approach is effective in raising the heat transfer to considerably higher levels, at the expense of an inevitably enlarged pressure drop penalty. The common types of such protrusions include a sequence of rib-shaped turbulators which induce periodic tripping of the boundary layer, unbounded shear layer formation and consecutive separation, followed by an eventual flow reattachment and wall-bounded shear layer development. This geometry thus provides an example of the methods of the present disclosure for increasing the heat transfer effectiveness.

The rotor-stator interaction of high-speed turbines represents a prominent mechanism of unsteady aerodynamic forcing. Associated frequency spectra feature characteristic peaks, which indicate the blade passing event, and its higher harmonic multiples or overtones. For an engine incorporating a blade such as that illustrated in FIGS. 9A and 9B, strong periodic excitation, associated with the rotor-stator interaction, is produced in frequency ranges from few kHz up to around 25 kHz. In the article entitled "Exploitation of Acoustic Effects in Film Cooling GT2014-26318" by M Collins and T. Povey, presented at the ASME Turbo Expo 2014—Turbine Technical Conference and Exposition, acoustic characteristics of travelling pressure waves in film holes is discussed, and the effects of periodic wake passing and unsteadiness effects on coolant mass flow fluctuations showed the importance of matching hole geometry to external source frequencies.

In this light, it should therefore be possible to apply the methods and results of the present disclosure also towards practical turbomachinery applications, such as that shown in FIGS. 9A and 9B. For the closely confined internal air flow inside the highly branched turbine blade cooling system, the acoustically coupled resonance behavior of interconnected passages and cavities is expected to exert a strong influence on the internal convection heat transfer. The acoustic resonance behavior of a characteristic high pressure (HP) turbine blade can be analyzed numerically. Typically having a length of less than 10 cm in span, the natural frequencies will be in the same frequency range (from few kHz up to around 25 kHz) as the strong periodic excitation produced by the rotor stator interaction. The internal design of the turbine blade, which defines the serpentine cooling passages, can be tailored to benefit from the aero-thermal impact of standing waves on roughened surfaces. Use of these resonance frequencies thus enables the heat transfer from the blade to the cooling air to be increased, according to the methods described in this disclosure, leading to a higher performance blade configuration.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

I claim:

1. A heat transferring device, comprising:

at least one internal passageway for fluid flow, said at least one internal passageway having at least one static element configured to generate turbulence in said fluid flow, and said at least one internal passageway having at least one acoustic resonance frequency when fluid flow is present in said at least one internal passageway; and a source for generating acoustic waves with a frequency at a harmonic of said at least one acoustic resonance frequency, said source being at least one of an externally powered device and a passive device, said source configured to apply said acoustic waves to a fluid passing through said at least one internal passageway, such that a standing wave is generated in said at least one internal passageway, wherein the at least one static element is such that the turbulence generated in said fluid flow comprises separating and reattaching flows which interact with said standing wave in said at least one internal passageway.

2. A heat transferring device according to claim 1, wherein said at least one static element which creates turbulence is said fluid flow comprises at least one of a rib, a pin, a fin, a dimple, a pin-fin, and a periodic array of any of the foregoing perturbation elements.

3. A heat transferring device according to claim 1, wherein said passive device is actuated by said fluid flow.

4. A heat transferring device according to claim 1 wherein said at least one acoustic resonance frequency is a plurality of acoustic resonance frequencies, said plurality of acoustic resonance frequencies being associated with different segments of said at least one internal passageway.

5. A heat transferring device, comprising:

at least one internal passageway for passing fluid therethrough, having at least one perturbation element, said at least one perturbation element comprising at least one of a rib, a pin, a fin, a dimple, a pin-fin, and a periodic array of any of the foregoing perturbation elements;

wherein said at least one internal passageway is constructed to have at least one acoustic resonance frequency when fluid flow is present therein, such that a harmonic of said resonance frequency matches an acoustic wave frequency derived from a source of pressure fluctuations, such that a standing wave is generated in said at least one internal passageway, wherein the at least one perturbation element is such that it generates in said fluid flow separating and reattaching flows which interact with said standing wave in said internal passageway.

6. A heat transferring device according to claim 5, wherein said acoustic source is either an externally powered device or is passively generated by said fluid flow.

7. A heat transferring device according to claim 5 wherein said at least one acoustic resonance frequency is a plurality of acoustic resonance frequencies, said plurality of acoustic resonance frequencies being associated with different segments of said at least one internal passageway.

8. A method of changing the thermal behavior of a heat transferring device, comprising:

providing a heat transferring device with at least one internal passageway, said at least one internal passageway having at least one static element which creates turbulence in fluid flow through said at least one internal passageway, and said at least one internal passageway having at least one acoustic resonance frequency to fluid flow in said at least one internal passageway;

generating acoustic waves with a frequency matching a harmonic of said at least one acoustic resonance frequency;

applying said acoustic waves to fluid passing through said at least one internal passageway, such that a standing wave is generated in said at least one internal passageway, wherein said changing of said thermal behavior arises from the interaction of said standing wave with a separating and reattaching flow of said fluid passing through said at least one internal passageway.

9. A method according to claim 8 wherein said at least one internal passageway comprises at least one channel which enables at least partial through flow and is at least partially bounded by semi-permeable or solid walls.

10. A method according to claim 8 wherein said at least one acoustic resonance frequency of said at least one internal passageway is associated with either the entire extent or a portion of said at least one internal passageway.

11. A method according to claim 8 wherein said at least one acoustic resonance frequency is a plurality of acoustic resonance frequencies, said plurality of acoustic resonance frequencies being associated with different segments of said at least one internal passageway.

12. A method according to claim 8, wherein said at least one perturbation element comprises at least one of a rib, a pin, a fin, a dimple, a pin-fin, a periodic array of any of the foregoing perturbation elements, a surface protrusion and a surface indentation that causes said fluid flow to be locally separated and reattached.

13. A method according to claim 8, wherein said generated acoustic wave is derived from a source of pressure fluctuations and matches said harmonic of said resonance frequency.

14. A method according to claim 8 wherein said method modulates the surface temperature distribution of said at least one internal passageway.

15. A method according to claim 8 wherein said acoustic wave frequency is a harmonic of any of a longitudinal, transverse, lateral, radial, or mixed mode(s) of said acoustic resonance.

16. A method according to claim 8, wherein said at least one acoustic resonance frequency is in the audible, the inaudible, the infrasound or the ultrasound frequency ranges.

17. A method according to claim 8 wherein said acoustic wave is generated either by at least one externally powered source, or is passively generated by said fluid flow.

18. A method according to claim 17 wherein said at least one externally powered source produces temporal acoustic pressure fluctuations through vibroacoustics or thermoacoustics.

19. A method according to claim 8 wherein said acoustic wave is generated by any combination of at least one of a fluid-dynamic, fluid-resonant, or fluid-elastic generator.

20. A method of changing the thermal behavior of a heat transferring device according to claim 8, wherein said acoustic waves are generating by at least one of an externally powered device and a passive device actuated by said fluid flow.

* * * * *